US008074429B2

(12) United States Patent
Hodges et al.

(10) Patent No.: US 8,074,429 B2
(45) Date of Patent: Dec. 13, 2011

(54) APPARATUS AND METHOD FOR PACKING SMOKING ARTICLES

(75) Inventors: Paul Hodges, Southampton (GB); Andrew Jonathan Bray, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 129 days.

(21) Appl. No.: 12/306,229

(22) PCT Filed: Jun. 20, 2007

(86) PCT No.: PCT/GB2007/002296

§ 371 (c)(1), (2), (4) Date: Apr. 23, 2009

(87) PCT Pub. No.: WO2008/012489

PCT Pub. Date: Jan. 31, 2008

(65) Prior Publication Data

US 2009/0241473 A1 Oct. 1, 2009

(30) Foreign Application Priority Data

Jul. 27, 2006 (GB) ..... 0614942.1

(51) Int. Cl.
*B65B 19/02* (2006.01)

(52) U.S. Cl. ..... 53/444; 53/148; 53/415; 206/268

(58) Field of Classification Search ..... 53/135.1, 53/136.1, 136.3, 136.4, 415, 444, 148; 206/257, 206/261, 264, 268, 273, 274

See application file for complete search history.

(56) References Cited

U.S. PATENT DOCUMENTS 2,320,006 A * 5/1943 Moore ..... 229/120.09
2,809,467 A * 10/1957 St Pierre et al. ..... 446/487
4,657,248 A * 4/1987 Benaim ..... 273/432
4,932,534 A * 6/1990 Focke et al. ..... 229/120.011
5,701,696 A * 12/1997 Clontz ..... 40/642.02

(Continued)

FOREIGN PATENT DOCUMENTS

WO WO2005/054056 A1 6/2005

(Continued)

OTHER PUBLICATIONS

International Search Report corresponding to PCT/GB2007/002296 mailed Sep. 18, 2007.

(Continued)

*Primary Examiner* — Thanh Truong

(74) *Attorney, Agent, or Firm* — Chadbourne & Parke LLP; Walter G. Handchuk

(57) ABSTRACT

A packaging apparatus comprises one or more packing machines (MC1, MC2, MC3) which are operable to join together at least two assembled packs (P1, P2). A strap applicator (MC4) applies a strap system (S) to one face of all but one of the assembled packs (P1, P2). Conveying means (TC) guide the assembled packs (P5 P1, P2) such that the face of each assembled pack (P1, P2) having the strap attached thereto abuts a face of another of the assembled packs such that the strap (S) is sandwiched between the abutting faces. Fixing means, which fix the strap (S) about adjacent packs such that the packs (P1, P2) are joined together and are movable relative to each other by rotation about one or more edges.

31 Claims, 6 Drawing Sheets

U.S. PATENT DOCUMENTS

| | | | | |
|---|---|---|---|---|
| 6,941,728 | B1 * | 9/2005 | Bray et al. | 53/449 |
| 7,155,882 | B2 * | 1/2007 | Ghini et al. | 53/444 |
| 7,347,033 | B2 * | 3/2008 | Gamberini et al. | 53/444 |

FOREIGN PATENT DOCUMENTS

| | | | |
|---|---|---|---|
| WO | WO2006/079799 | A1 | 8/2006 |

OTHER PUBLICATIONS

Written Opinion corresponding to PCT/GB2007/002296 mailed Sep. 18, 2007.

International Preliminary Report on Patentability corresponding to PCT/GB2007/002296 issued Jan. 27, 2009.

* cited by examiner

Fig. 1
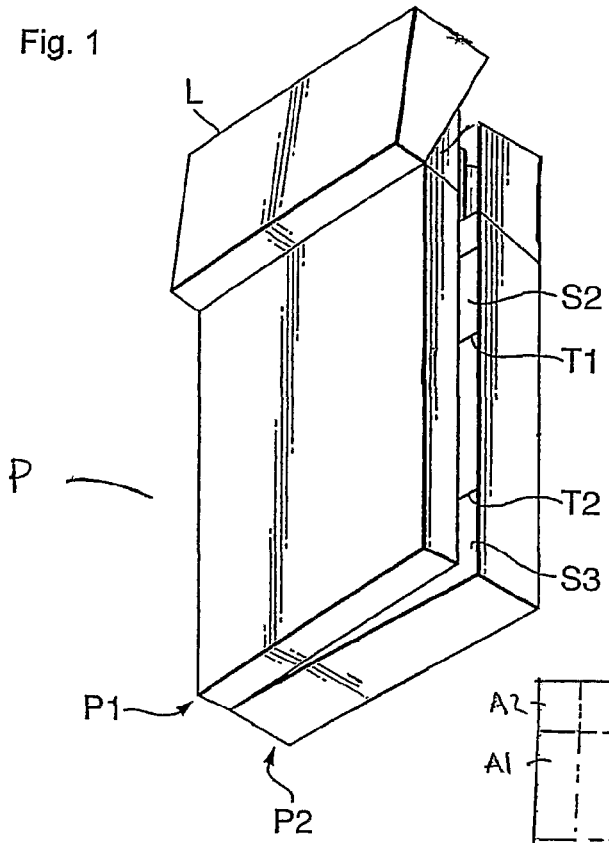
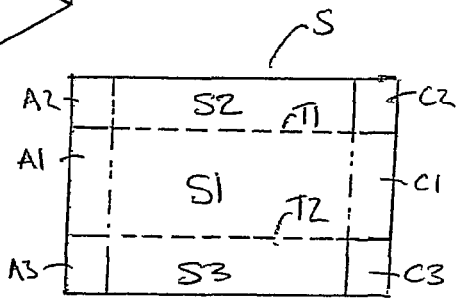
Fig. 2b
Fig. 2a
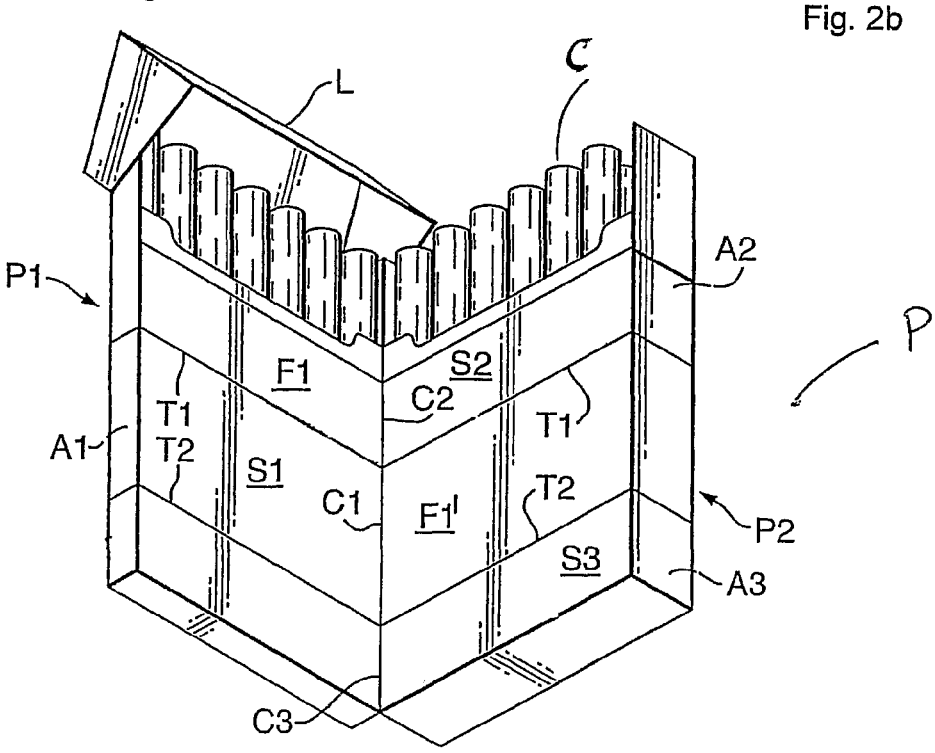

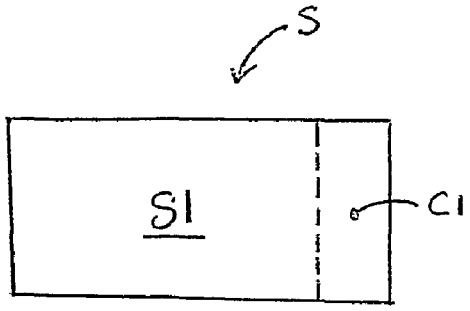
Fig. 3b
Fig. 3a
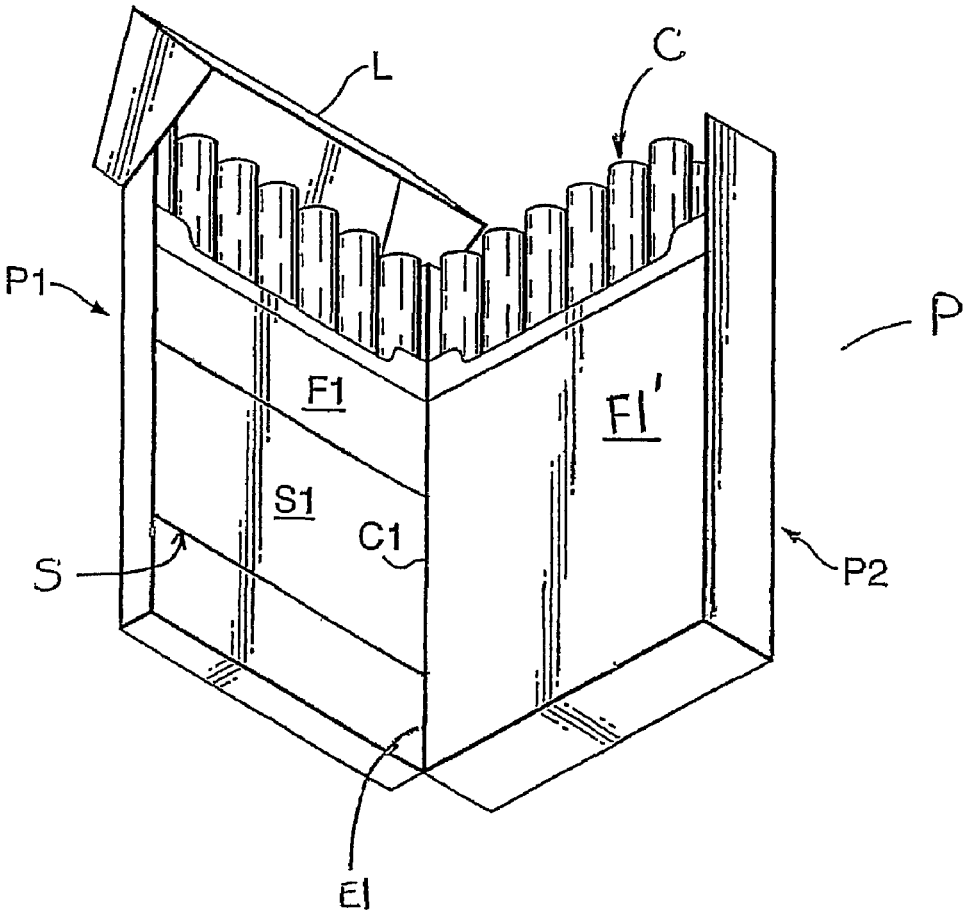

APPARATUS AND METHOD FOR PACKING SMOKING ARTICLES

CLAIM FOR PRIORITY

This application is a National Stage Entry entitled to and hereby claims priority under 35 U.S.C. §§365 and 371 corresponding to PCI Application No. PCT/GB2007/002296, titled, "Apparatus and method for packing smoking articles," filed Jun. 20, 2007, which in turn claimed priority to UK Application Serial No. 0614942.1, filed Jul. 27, 2006, all of which are hereby incorporated by reference.

This invention relates to apparatus and methods for packaging smoking articles such as cigars, cigarillos and cigarettes. In particular, the invention relates to apparatus and a method of forming a pack that comprises two packs joined together in a manner such that the two packs are movable relative to each other by rotation about one or more different edges.

An apparatus operable to connect two (or more) cigarette packs together is known. An apparatus for combining two packs in a hinged side-by-side relationship is the subject of the co-pending PCT patent application WO 05/054056, which application is incorporated herein by reference.

An example of a pack formed by the apparatus and method of assembly described herein is the subject of the co-pending PCT patent application PCT/GB2006/000245, which application is incorporated herein by reference.

Accordingly, the present invention provides a packaging apparatus comprising: one or more packing machines operable to assemble a plurality of assembled packs, a strap applicator operable to apply a strap to one face of all but one of the plurality of assembled packs; conveying means operable to guide the assembled packs such that the face of each assembled pack having the strap attached thereto abuts a face of another of the plurality of the assembled packs such that the strap is sandwiched between the abutting faces; and fixing means operable to fix the strap about the packs such that the packs are joined together.

Separate packing machines may assemble respectively each of the plurality of assembled packs. For example a first packing machine may be operable to assemble a first assembled pack and a second packing machine may be operable to pack a second assembled pack. The packing machines may be arranged in a parallel arrangement, wherein the apparatus further comprises adjusting means operable to adjust the orientation of at least one of the plurality of assembled packs into a position to abut face-to-face with an adjacent pack of the plurality of assembled packs. The reorientation of the packs may be such that each of the plurality of assembled packs is in the same orientation. The adjusting means may be an inverting unit, which is operable to flip at least one of the plurality of assembled packs over such that a leading edge of the pack on entry to the inverting unit becomes a trailing edge on exit from the inverting unit.

The adjusting means may be part of the conveying means whereby the at least one of the plurality of assembled packs is inverted through 180° in an arcuate feed path. The inversion of the assembled pack may occur under the action of gravity.

Alternatively, the first and second packing machines may be arranged in series, wherein one machine is placed upstream of the other in the production process. When the machines are arranged in series the first and second packs may be output from respective machines in the same orientation therefore there may not be a need to change the orientation of the packs. Therefore, the adjusting means may not be required.

Preferably, the fixing means is configured to receive the plurality of assembled packs, wherein adjacent packs are in a face-to-face arrangement with the strap sandwiched therebetween. The strap may be a single strap. Preferably, the strap is configured to separate into two or more separate straps. The size of the strap is such that it is wider than the abutting faces of the adjacent assembled packs such that an end region of each strap overhangs both edges of the abutting faces of the adjacent assembled packs. Suitably, for packs that are movable relative to each other by rotation about one edge, the strap may be attached to one or both of the abutting faces. Alternatively, the strap may be applied to an abutting faces on one pack and to a side panel on the adjacent pack. Preferably, for packs that are arranged to move relative to each other by rotation about two or more edges, the overhanging end region comprises two or more separate sections, which are fixable by the fixing means to faces other than the abutting faces on the first and second assembled packs such that each strap is fixed to two adjacent packs, thereby joining the adjacent packs together such that they are movable relative to each other by rotation about two or more different edges. The apparatus may further comprise adhesive application means, which applies adhesive to either the strap or corresponding regions on the packs such that each strap can be adhered to each of two adjacent assembled packs. Alternatively, the apparatus may further comprise adhesive activation means for activating adhesive, which is pre applied to the strap or corresponding regions of the packs.

The adhesive application means preferably applies adhesive to the end regions of the straps such that the straps can be fixed to the packs. Alternatively, or in addition the adhesive may be applied to corresponding regions on the faces of the packs to which the end regions of the straps are to be fixed. Alternatively, the end regions of the straps may be primed with an adhesive such as heat activated or water activated adhesive that will be activated by the adhesive activation means.

The apparatus may further comprise pressure application means. Following application or activation of the adhesive, the pressure application means is suitably operable to apply pressure to the end regions of the straps to promote sound adhesion between the end regions and the receiving faces of each pack.

The apparatus may further comprise heating means, which may be suitable to heat the end regions of the straps such as to activate adhesive applied thereto. Alternatively, or in addition the heating means may promote setting of the applied or activated adhesive such that the efficiency of joining the components together may be improved.

The apparatus may further comprise cooling means, which may be operable to cool the assembled packs to promote efficient setting of the adhesive.

One of the one or more packing machines may be operable to complete assembly of the plurality of assembled packs by applying an outer blank to the combination of assembled packs, wherein the outer blank may comprise a lid portion, which is foldable by one of the one or more packing machines. One of the one or more packing machines may be operable to fold a lid portion, which may be provided as an integral part of one or more of the plurality of assembled packs.

Preferably, the one or more packing machines comprise a smoking article receiving station, a foil wrapping unit, an inner frame blank conveyor, a folding station and conveying means.

The present invention further provides a method of making a pack, the method comprising the steps of the steps of assembling a plurality of assembled packs, applying a strap to one face of all but one of the plurality of assembled packs; guiding the plurality of assembled packs such that the face of each assembled pack having the strap applied thereto abuts a corresponding face of another of the plurality of assembled packs and thereby sandwiching the strap between the abutting faces; and fixing the strap about adjacent packs such that the packs are joined together and are movable relative to each other by rotation about one or more edges.

Depending on the orientation of the plurality of assembled packs on exit from the packing machine(s), the method may further comprise the step of adjusting the orientation of at a least one of the plurality of assembled packs such that the orientation of each of the plurality of packs is the same.

The method of making the pack may further comprise the step of assembling an outer frame member about the combination the plurality of packs and the strap. The outer blank may include a lid portion, wherein the method further comprises the step of folding the lid portion about the packs. Alternatively, wherein at least one of the plurality of assembled packs includes a lid portion, the method may include the step of folding the lid portion about the packs.

The method may further comprise applying an outer cellophane wrapper to the pack.

Embodiments of the present invention will be described by way of example only with reference to the accompanying drawings in which:

FIG. 1 is a perspective view of a pack comprising two packs joined together by a strap system and having a single hinge-lid, which closes both packs when in the closed arrangement as illustrated;

FIG. 2*a* is a perspective view of two packs joined together by a strap system comprising three straps such that the packs are rotatable relative to each other about two different edges;

FIG. 2*b* illustrates a strap system, as applied to the packs in FIG. 2*a* thereby joining two packs together;

FIG. 3*a* is a perspective view of two packs joined together by an alternative strap system to that of FIGS. 2*a* and 2*b;*

FIG. 3*b* illustrates the strap system, comprising one strap, which joins the two packs of FIG. 3*a* together;

FIG. 4*a* is a perspective view of two packs joined together by a strap system comprising three straps such that the packs are rotatable relative to each other about two different edges;

FIG. 4*b* illustrates a strap system, as applied to the packs in FIG. 4*a* thereby joining two packs together;

Figure 4B:
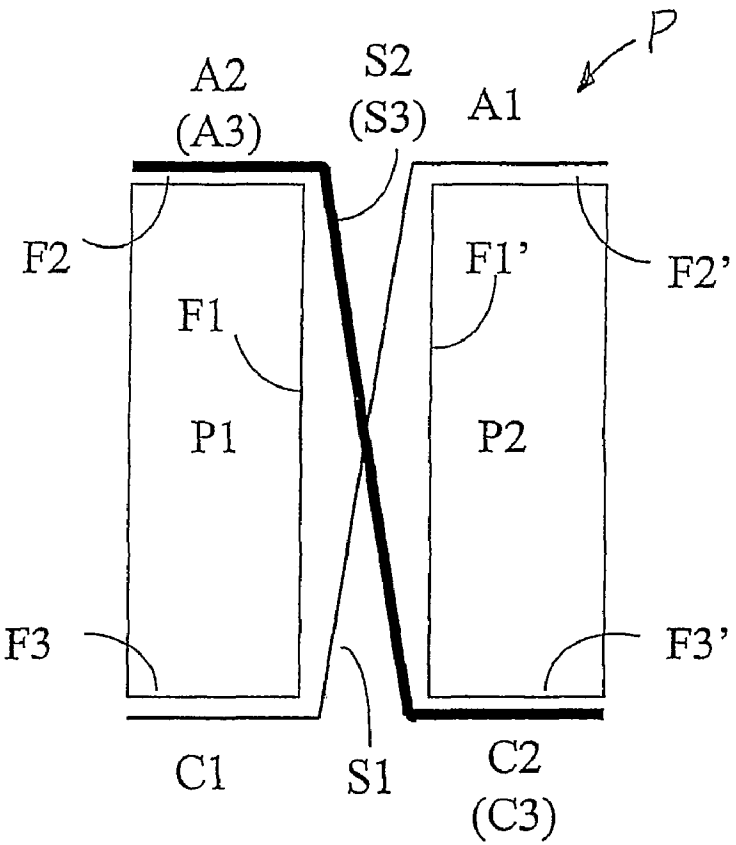

Referring to FIGS. 1, 2*a*, 3*a* and 4*a*, a cigarette packet P is formed by joining together two separate packets P1, P2 by means of a strap system S.

The illustrated examples comprise one pack P1, which contains seven (7) cigarettes C and another pack P2 that contains thirteen (13) cigarettes C. In both packs P1, P2, the cigarettes C are wrapped in a foil inner wrapper (not shown), and a further wrapper of paper or card to form a more rigid inner and/or outer frame. The two packs P1, P2 are arranged with faces F1, F1' in a face-to-face abutting relation and the strap system S is sandwiched between them. The strap system S may comprise a single strap (see FIGS. 3*a* and 3*b*), a perforated strap (see FIGS. 2*a* and 2*b*) or to form a combined pack arrangement such as that illustrated in FIGS. 2*a*, 4*a* and 4*b* the strap system may comprise a plurality of individual straps. In the examples illustrated in FIGS. 3*a* and 3*b*, the strap system is provided by a single strap S. In FIGS. 2*a*, 2*b*, 4*a* and 4*b* the strap system S is provided by a single strap S comprising perforated regions T1, T2 such that the strap S is divisible into three separate straps S1, S2, S3. The perforated regions T1, T2 on the strap S facilitate separation of one strap from another after the packs P1, P2 are joined together. The strap S is wider than the packs P1, P2 such that an overhang section on each side of the pack is provided. At each side the overhang is separated into number of tabs that correspond with the number of straps; in this example there are three (3) tabs on each side A1, A2, A3 and C1, C2, C3. The tabs A1, A2, A3 and C1, C2, C3 facilitate attachment of the strap system S to the separate packs P1, P2 thereby joining them together such that the packs P1, P2 are movable relative to each other by rotation about two or more edges. Each tab A1, A2, A3 and C1, C2, C3 is fixed to one of the two packs on a side face. The straps may be longer than is described above such that they may be fixed to a face of the pack other than the side face. Alternatively, the straps S1, S2, S3 may be of a suitable length such that they extend around the pack and the end regions of the strap(s) may be fixed to a region on the same strap.

Referring to FIG. 3*a*, there is illustrated an assembly P of first and second assembled packs P1 and P2 that are joined together by a single strap S. The strap S is fixed in part to the front face F1 of the first assembled pack P1 and in part to a side face of the second assembled pack P2 such that the two packs are movable relative to each other, by rotation about one edge E1.

The description that follows relates to the examples illustrated in FIGS. 1, 2*a*, 2*b*, 4*a* and 4*b*, wherein there are three (3) straps S1, S2, S3 and wherein tabs A1 and C1 form the ends of strap S1, tabs A2 and C2 form the ends of strap S2 and tabs A3 and C3 form the ends of strap S3. The tabs A1, A2, A3, C1, C2, and C3 are attachable to the side panels of the packs P1, P2. For example, the tab A1 is attached to a side panel of the first pack P1 and C1 is fixed to an opposite side panel of the second pack P2. The remaining straps S2 and S3 are adjacent to the first strap S1 and are arranged such that tabs A2 and A3 attach to the second pack P2 on the side panel that is opposite to the side panel having tab C1 attached thereto. The tabs C2 and C3 are fixed to the first pack P1 and to the side panel that is opposite to the side panel having tab A1 attached thereto.

By fixing the tabs A1, A2, A3 and C1, C2, C3 to the packs P1, P2 in this manner the two packs are joined together and they are movable relative to each other by rotation about two different edges.

FIGS. 1, 2*a* and 3*a* illustrate a pack P, wherein the strap system S is attached to two packs P1 and P2, which are closeable when arranged face-to-face by a single hinged lid L.

Figure 4A:
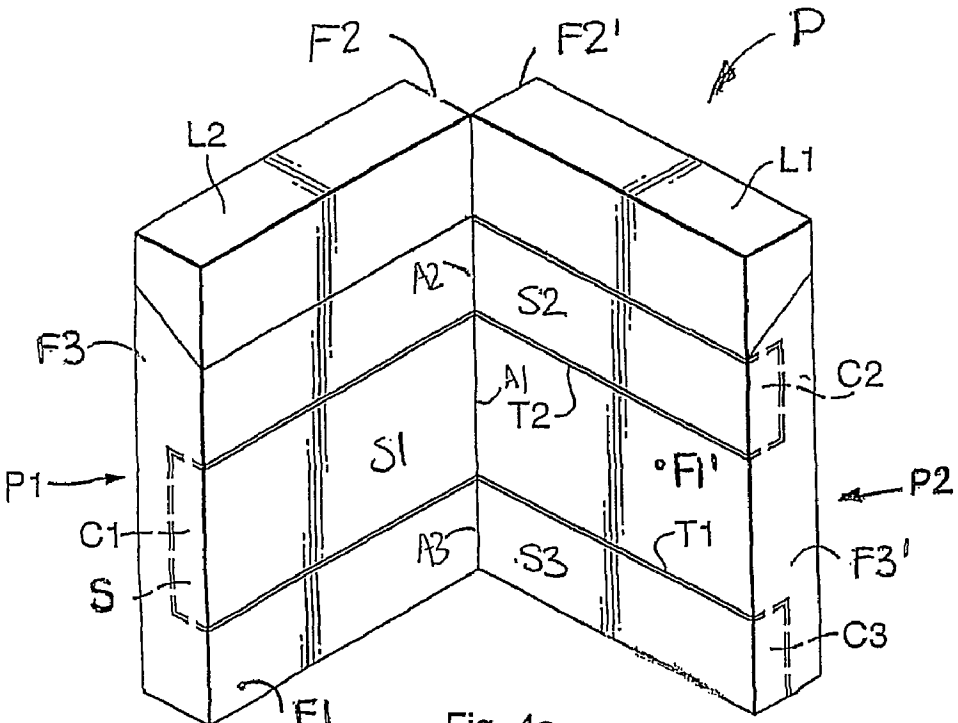

FIG. 4*a* illustrates a pack P, wherein the strap system S is attached to two packs P1, P2, which are each closable by separate hinged-lids L1, L2.

Figure 5:
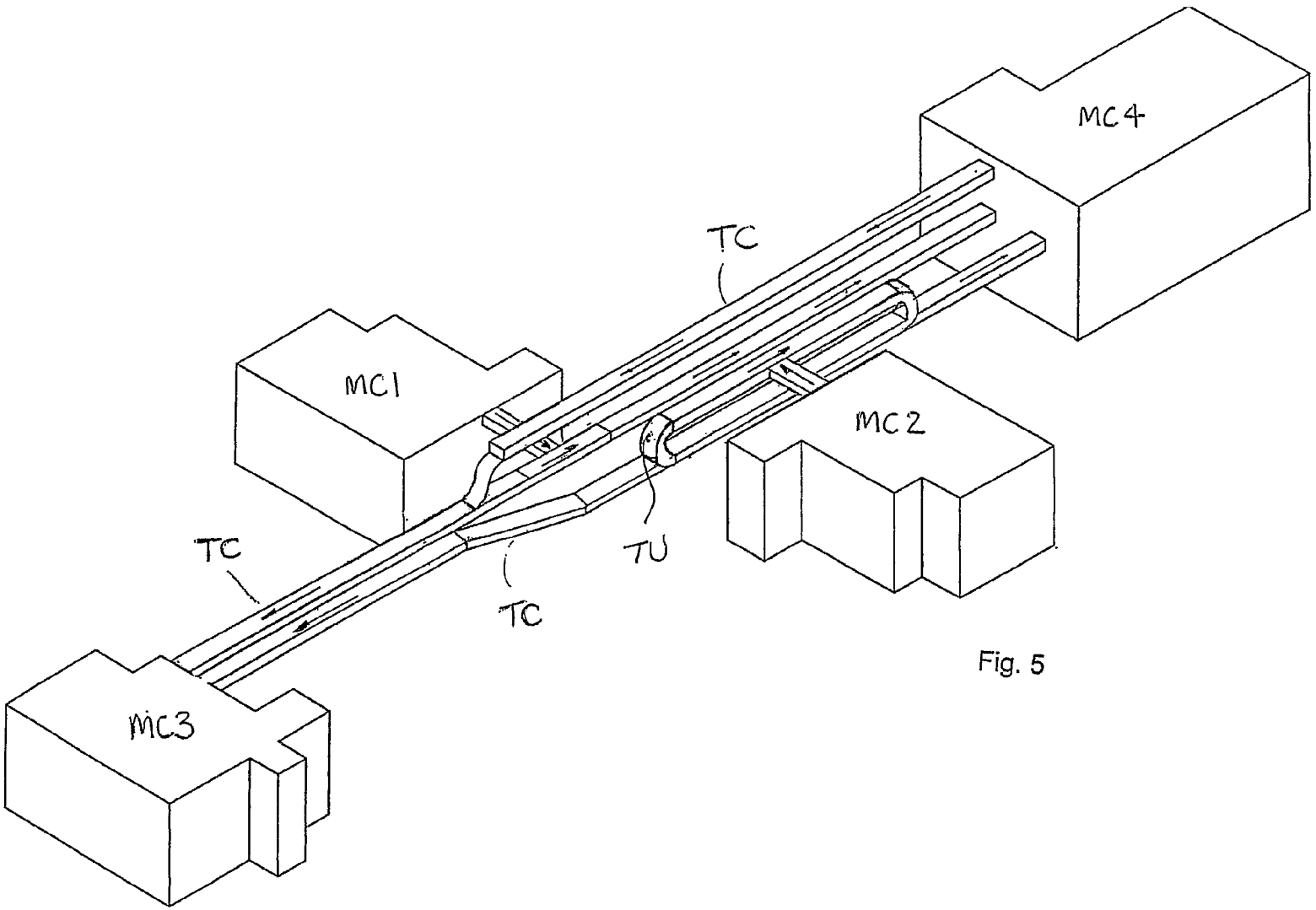
FIG. 5 is a schematic layout of the packaging apparatus used to form the packs of FIGS. 1, 2 and 4.
Figure 6:
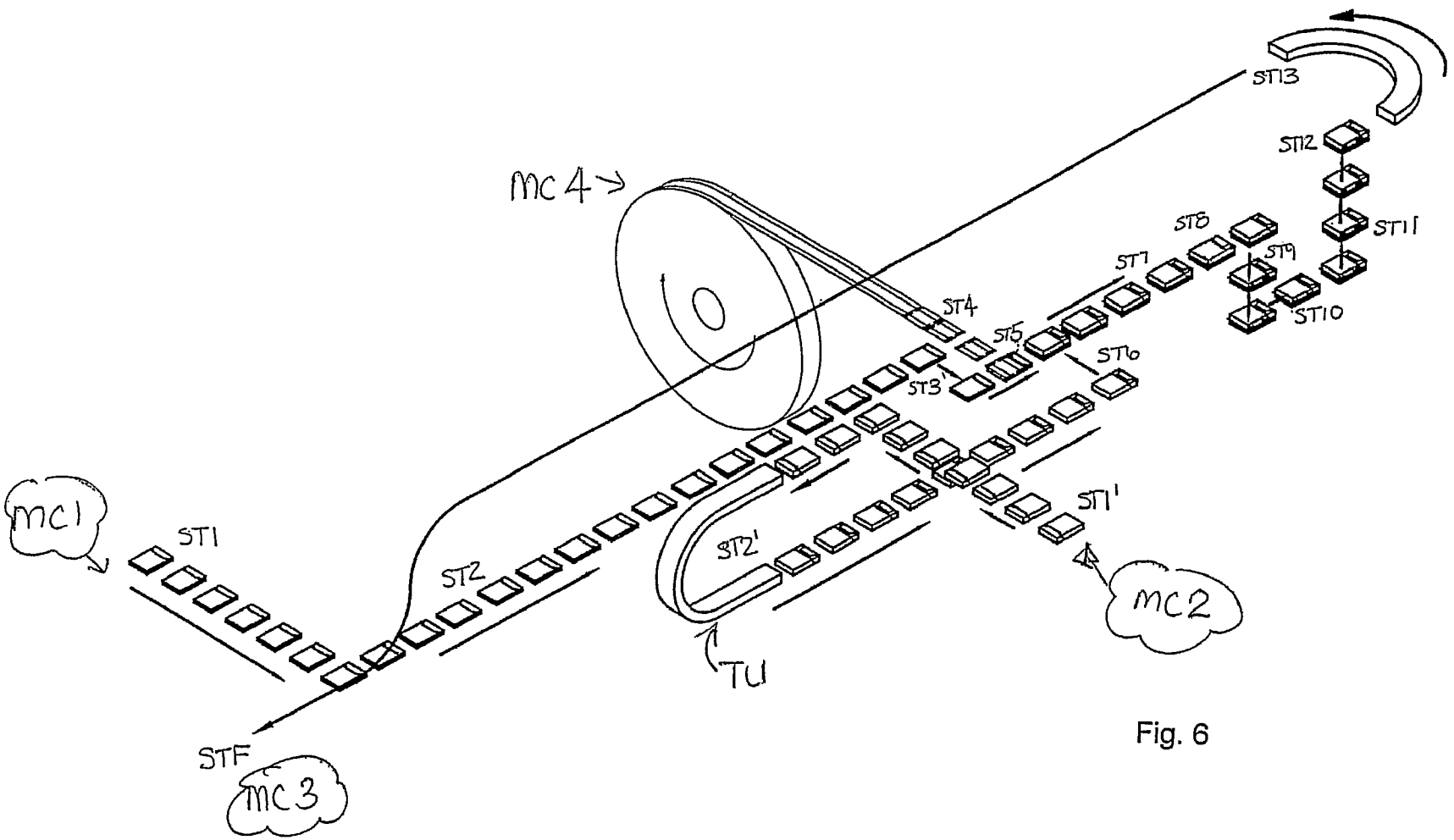
FIG. 6 is a schematic representation of the assembly process for forming the pack of FIGS. 1, 2*a*, 3*a* and 4.
Figure 7:
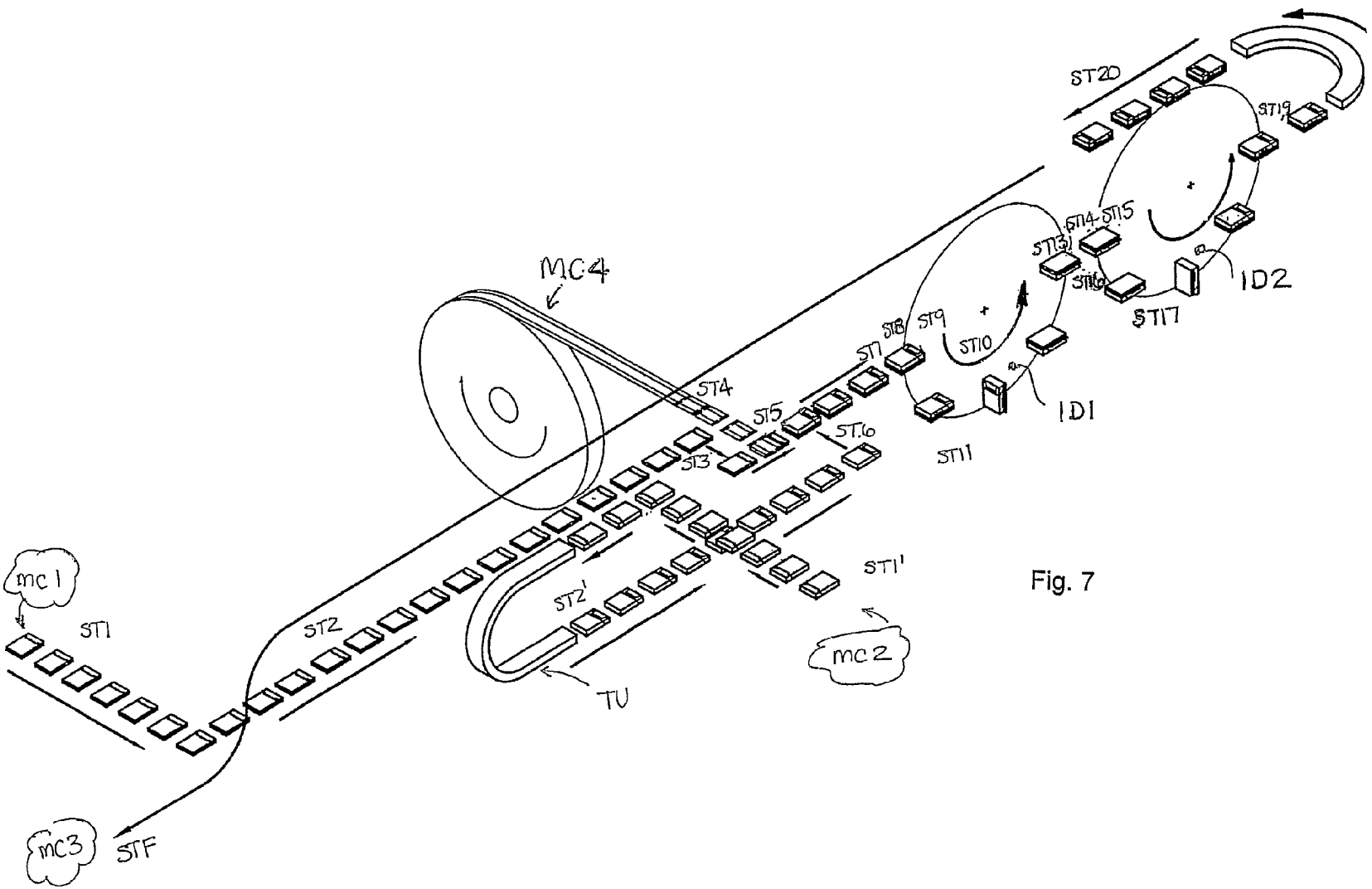
FIG. 7 is a schematic representation of an alternative assembly process to that of FIG. 6.

Referring to FIGS. 5, 6 and 7, there is illustrated a schematic of the components forming the packaging apparatus and the path which the components forming the pack P follow during production. In the example illustrated, the packaging apparatus utilises three separate packing machines MC1, MC2 and MC3. This arrangement is particularly suited to making the pack P as illustrated in FIGS. 1 and 2, wherein an outer blank member carrying a single lid portion L, which closes both packs P1 and P2 is added to the combination of the first pack P1, the second pack P2 and the strap system S at the third packing machine MC3. The outer blank is fixed to one or both of the first and second packs P1, P2 and the single lid portion L is folded such that both packs P1, P2 are closed (see FIG. 1).

The description that follows is directed to the packaging apparatus as illustrated in FIGS. 5, 6 and 7, all of which utilise three separate packing machines MC1, MC2, MC3 and a strap applicator MC4.

FIG. 5 shows a simplified schematic representation of the packaging apparatus.

Wrapping machines MC1 and MC2 each receive cigarettes and bundle them respectively into bundles of seven (7) and thirteen (13) cigarettes and wrap them to form the first and second packs P1, P2 for combining to form the combined pack P. Other quantities and combinations of quantities of cigarettes may be used to form the packs. For example, one pack comprising a bundle of seven (7) and one pack comprising a bundle of ten (10) cigarettes is suitable for vending packs.

In the orientation shown the second packing machine MC2 is arranged in parallel with the first packing machine MC1. Therefore, the orientation of the pack P2 on exit from the second packing machine MC2 is different than the orientation of the first pack P1 on exit from the first packing machine P1. A turnover unit TU is included as part of the conveyer system at the exit of the second packing machine MC2 and is operable to flip/rotate the second pack P2 through 180 degrees on exit from the second packing machine MC2. By flipping/rotating the second assembled pack P2 the leading edge of the second assembled pack P2 on exit from the second packing machine MC2 becomes the trailing edge of the pack P2 on entry to the strap applicator MC4. Therefore, both packs P1 and P2 enter the strap applicator MC4 with the top (lid end) of the packs leading.

The strap applicator MC4 is operable to apply the strap system S between the first and second packs P1, P2 and to fix the end regions (tabs) A1, A2, A3, C1, C2, C3 of the straps to the first and second assembled packs P1, P2 such that they are combined to form the pack P, wherein the two packs P1, P2 are movable relative to each other by rotation about two different edges.

Transfer conveyors TC carry the packs P1, P2, P to and from the packing machines MC1, MC2, MC3 and the strap applicator MC4 during each stage of the packaging process.

In the embodiments described and illustrated the third packing machine MC3 receives the combined pack P from the strap applicator MC4 and is operable to conduct any final packaging steps before the final retail pack is output. For example, if a single lid L is applicable (see FIGS. 1 and 2*a*) the third packing machine MC3 may be operable to apply to the combined pack P, an outer blank (not illustrated) having the lid portion L attached thereto. The third packing machine MC3 may also be operable to fold the lid portion L. Alternatively, the single lid L may be included as part of one of the first or second assembled packs P1, P2, wherein the third packing machine MC3 would be operable to fold the lid portion L such that the pack P is closable.

The first and second assembled packs P1 and P2 may have separate lids L1, L2 (see FIG. 4*a*), wherein the first and second assembled packs P1, P2 are individually closable by their respective lid. In this example, the first and second packing machines MC1, MC2 may complete the assembly of the combined pack by folding the lid portions prior to the packs being combined to form pack P. Therefore, the third packing machine MC3 may be dispensed with.

With appropriate adaptation to the conveyor system it is possible that one machine combined with a strap applicator MC4 may be used to produce the separate packs P1 and P2 and finally the combined pack P.

The method of packaging the cigarettes in the combined pack P is illustrated in FIGS. 6 and 7.

Referring to both FIGS. 6 and 7, the first stages ST1 and ST1' of the packaging process is the simultaneous packing of a first bundle of, for example seven (7) cigarettes in the first packing machine MC1 and packing a second bundle of for example thirteen (13) cigarettes in the second packing machine MC2. On exit from both machines MC1, MC2 the respective packs P1, P2 are transferred via a system of transfer conveyers TC that run in parallel from the first and second machines MC1, MC2 to the next stage in production ST4 to ST8; namely applying the strap system S to join the first and second assembled packs P1, P2 together.

Prior to entering the strap applicator MC4, the second assembled pack P2 is inverted ST2' through 180 degrees to correct the orientation of the pack such that both the first and second assembled packs P1, P2 enter the strap applicator MC4 with the lid end leading.

The first assembled pack P1, containing seven (7) cigarettes, is fed ST3 into the strap applicator MC4 and a strap or straps which form the strap system S is output ST4 from the strap applicator MC4 and is placed ST5 on top of the first pack P1. The second pack P2 is transferred ST6 to the strap applicator MC4 such that the strap system S is sandwiched between the first and second assembled packs P1, P2. The combination P of first and second assembled packs P1, P2 and the strap system S is transferred ST7 via a conveyor to a first gluing station, wherein glue spots may be applied to a first set of the tabs C1, A2 and A3 or corresponding regions on the side panels of the first and second assembled packs P1, P2.

Referring to FIGS. 6 and 7, the process of combining the first and second assembled packs P1, P2 and applying the strap(s) S is the same up to this stage ST8. Thereafter, FIGS. 6 and 7 each illustrate different processes of fixing the tabs A1, A2, A3, C1, C2, C3 to the first and second assembled packs P1, P2. The process of joining the first and second assembled packs P1, P2, by fixing the strap(s) S1, S2, S3 to the packs P1, P2 is indicated by process steps ST9 and onwards.

Referring to FIG. 6, after application of adhesive ST8 to the tabs or the side panels of the packs P1, P2 the combined pack and strap assembly P is driven downwards between folding guides, such that tabs C1, A2 and A3 are pushed upwards. The combination P is transferred ST10 to another gluing station, wherein glue is applied to tabs A1, C2 and C3 or to corresponding regions on the side panels of the packs P1, P2 before the combined pack and strap assembly P is passed upwards between the folding guides such that the tabs A1, C2 and C3 are forced downwards and into contact with the side panels of the packs P1 and P2. The folding guides may be heated such as to improve gluing efficiency.

The folding guides may be provided by, for example, rollers or pressure plates. Cooling means may also be utilised to provide a cooling step (not illustrated) wherein the speed of setting the adhesive may be accelerated.

In the example illustrated in FIG. 7, following application of adhesive ST8 the combined pack P and strap assembly passes to an index drum ID1, which rotates counter clockwise ST10 to effect upward folding ST11 of the tabs C1, A2 and A3 such that they are fixed to the side panels of packs P1 and P2. The combined pack P is transferred ST13 out of the first index drum ID1 to a gluing station, wherein glue is applied to tabs A1, C2 and C3 or corresponding regions on the side panels of packs P1 and P2 before the combined pack P is transferred to the second index drum ID2, which rotates counter clockwise to effect upward folding ST17 of tabs A1, C2 and C3 into contact with the side panels of the packs P1 and P2. The first and second index drums ID1, ID2 may be heated to improve gluing efficiency. Cooling means (not illustrated) may also be utilised to provide a cooling step (not illustrated) wherein the speed of setting the adhesive may be accelerated.

A single index drum (not illustrated) may perform the combined process of the first and second index drums ID1, ID2. The drum or drums may be arranged to rotate clockwise or counter clockwise or the rotational direction may be changed during the fixing process. In FIG. 7, the index drums ID1, ID2 are shown in a vertical orientation. However, the drum or drums may be arranged in an inclined plane or horizontal.

On exit from the gluing and fixing stations in both examples described above, the combined pack P is transferred ST13, ST19 to a turnaround unit to reverse the orientation of the combined pack P before transferring it downstream to the third packing machine MC3 for the final packing step STF. The final stage STF may include applying an outer casing and lid blank to the combine pack P and folding the lid portion. Alternatively, the final packing step STF may include folding the lid portion L to form a lid, wherein the lid portion L is carried by one of the first or second assembled pack P1, P2.

Strap(s)

In the embodiments illustrated in FIGS. 6 and 7, the strap S is bobbin fed onto the first assembled pack P1 as a continuous strip. This arrangement requires cutting/separation of one complete strap system S comprising straps S1, S2, S3 from the next complete strap system S. Therefore, the bobbin-fed strap may include perforated regions to separate one strap S1, S2, S3 from the next. The apparatus would therefore require a cuffing station, thereby introducing a cutting step in the method of production prior to application of the strap S to the first assembled pack P1. The bobbin-fed straps S may be pre-printed. Therefore, the apparatus would preferably include a print registration system to ensure efficiency in placement and cutting of the strap at the correct location. Alternatively, straps may be provided individually in a stackable form. The individual straps may be magazine fed onto the first assembled pack P1 at step ST5 of the packaging process.

Individual straps S1, S2, S3 may be applied separately to the first assembled pack P1, either by a single strap applicator MC4 or by separate strap applicators (not shown).

Machine Layout

In the embodiments illustrated the first and second packing machines MC1, MC2 are arranged in parallel, which as discussed above requires an inverter/turnover unit TU such that the orientation of one pack is corrected with respect to the other pack. Alternatively, the first and second machines MC1, MC2 may be placed in series with the second machine MC2 being upstream of the first packing machine MCI. It will be appreciated that the transfer conveyor system TC would require modification to ensure that the transfer of the second pack P2 to the strap applicator MC4 is timed such that the strap(s) is sandwiched between the first and second assembled packs P1, P2.

The embodiments described and illustrated utilise at least two packing machines. However, it will be appreciated that each machine performs a number of processes and indeed it is possible that one packing machine could perform the processes to join two or more packs together.

A single machine (not illustrated) could also incorporate the features of the strap applicator MC4 and the final packing machine MC3, such that a single unit begins and completes the process of joining two or more packs together.

Each of the examples described above combine two assembled packs together. However, the same apparatus and process may be used to combine more than two packs together, wherein a strap system S will be applied to one face of all but one of the packs being joined together.

Components of the First and Second Packing Machines (not Illustrated)

Cigarettes are initially fed into the packing machine at a receiving station. Subsequently, the cigarettes are aligned and placed on a conveyor to be bundled into appropriate amounts such as bundles of seven or thirteen ready for packing. After bundling the cigarettes, they may pass through a wrapping station wherein the cigarettes are closely packed in foiled paper. The foil may be bobbin-fed such that the foil wraps the requisite cigarette bundle as necessary and also applies the necessary perforations along an upper section for easy removal by the consumer on opening the pack. The foil wrapped bundle is then conveyed to an individual folding station in an inner frame blank conveyor. In addition, a blank feed mechanism, which conveys an inner frame blank member into an individual folding station in the inner frame blank conveyor, may also be part of the packing machine.

The individual folding station may comprise a rounded pocket, a square pocket or a bevelled pocket such that the shape of the pocket is suitable for an inner frame blank member having respectively rounded square or bevelled longitudinal margins.

Inner frame blank members may be folded about the foil-wrapped bundles of cigarettes within the packing machine thereby forming the assembled packs Pt, P2.

Assembly of Packs Before Inserting Cigarettes

Each of the examples described relate to the assembled packs P1, P2 each containing cigarettes on exit from the packing machines MC1, MC2. However, the first and second assembled packs P1, P2 may be assembled without any cigarettes and the cigarettes may be inserted downstream in the process of joining the packs together. The cigarettes may be inserted into the packs P1, P2 prior to the final process step STF, wherein the lid portion L is folded and the packs P1, P2, P are closed.

In conclusion, although a variety of embodiments have been described herein, these are provided by way of example only, and many variations and modifications on such embodiments will be apparent to the skilled person and fall within the scope of the present invention, which is defined by the appended claims and their equivalents.

The invention claimed is:

1. A packaging apparatus comprising:

one or more packing machines operable to assemble a plurality of assembled packs, a strap applicator operable to apply a strap to one face of all but one of the plurality of assembled packs;

conveying means operable to guide the assembled packs such that the face of each assembled pack having the strap attached thereto abuts a face of another of the plurality of the assembled packs such that the strap is sandwiched between the abutting faces; and fixing means operable to fix the strap about adjacent packs such that the packs are joined together and are movable relative to each other by rotation about one or more edges.

2. An apparatus according to claim 1, further comprising adhesive application means operable to apply adhesive to the strap or to a corresponding region on adjacent packs.

3. An apparatus according to claim 1, further comprising adhesive activating means to activate adhesive, wherein the strap or regions of the packs are primed with adhesive to be activated.

4. An apparatus according to claim 1, further comprising attaching means operable to attach the strap about adjacent packs such that adjacent packs are movable relative to each other about one or more edges.

5. An apparatus according to claim 4, wherein the attaching means is operable to attach part of the strap to the pack having the strap applied thereto and to attach another part of the strap to an adjacent pack, which adjacent pack abuts the pack having the strap applied thereto.

6. An apparatus according to claim 5, wherein the attaching means comprises a guide system operable to receive the assembly of the plurality of packs and the strap, and wherein the combination of packs and strap pass through the guide system in one direction such that end regions of the strap are forced to move in the opposite direction, wherein part of each strap attaches to a respective one of two faces of adjacent packs, the two faces being faces other than the abutting faces.

7. An apparatus according to claim 5, wherein the attaching means comprises one or more rotatable indexing drums operable to receive the assembly of the plurality of packs and the strap, and wherein the assembly of the plurality of packs and the strap are rotatable with the drum in one direction to cause end regions of the strap to move in a direction towards the packs such that each end region of the strap attaches to a respective one of two faces of adjacent packs, the two faces being faces other than the abutting faces.

8. An apparatus according to claim 7, wherein the dispensing means further comprises cutting means operable to cut individual strap systems from the continuous strip dispensed therefrom.

9. An apparatus according to claim 1, wherein the fixing means further comprises a heater.

10. An apparatus according to claim 1, wherein the fixing means further comprises a cooler.

11. An apparatus according to claim 1, further comprising adjusting means operable to adjust the orientation of at least one of the plurality of packs such that the plurality of packs are in the same orientation.

12. An apparatus according to claim 1, wherein the strap applicator comprises strap dispensing means operable to dispense a continuous strip comprising a plurality of strap systems connected together.

13. An apparatus according to claim 12, wherein the strap system comprises one or more straps.

14. An apparatus according to claim 1, wherein the strap applicator comprises dispensing means operable to dispense strap systems singly.

15. An apparatus according to claim 1, further comprising registration means operable to control placement of a strap system relative to a receiving face of all but one of the plurality of assembled packs.

16. A method of making a pack comprising:

assembling a plurality of assembled packs, applying a strap to one face of all but one of the plurality of assembled packs;

guiding the plurality of assembled packs such that the face of each assembled pack having the strap applied thereto abuts a corresponding face of another of the plurality of assembled packs and thereby sandwiching the strap between the abutting faces; and fixing the strap about adjacent packs such that the packs are joined together and are movable relative to each other by rotation about one or more edges.

17. A method according to claim 16, further comprising adjusting the orientation of at least one of the plurality of packs such that the plurality of packs are in the same orientation.

18. A method according to claim 16, wherein applying the strap includes dispensing a strap from a continuous strip or singly.

19. A method according to claim 16, further comprising applying adhesive to the strap or corresponding region on adjacent packs.

20. A method according to claim 19, wherein the adhesive is applied to one face of each adjacent pack, wherein the face on each adjacent pack is a face other than the abutting faces of adjacent packs.

21. A method according to claim 20, further comprising mating the corresponding regions of the strap and faces of the adjacent pack such that adjacent packs are joined together and are movable relative to each other by rotation about one or more edges.

22. A method according to claim 16, further comprising activating adhesive, which is pre-applied to the strap or corresponding region on adjacent packs.

23. A method according to claim 16, wherein the fixing comprises moving the combination of the plurality of packs and the strap in one direction to effect movement of end regions of the strap in an opposite direction.

24. A method according to claim 16, wherein the fixing comprises rotating the combination of the plurality of packs and the strap to effect movement of end regions of the strap in a direction such that the end regions of the straps are fixed to corresponding faces of adjacent packs.

25. A method according to claim 16, further comprising applying an outer frame member, which includes a lid portion to the combination of plurality of packs and the strap and folding the outer blank and lid portion about the combination of the plurality of packs and the strap.

26. A method according to claim 16, wherein one of the plurality of packs comprises a lip portion attached thereto, further comprising folding the lid portion about the combination of the plurality of packs and the strap.

27. A method according to claim 16, further comprising applying a cellophane outer wrapper to the combination of the plurality of packs and the strap.

28. A method according to claim 16, comprising assembling respective assembled packs about respective bundles of smoking articles prior to joining together the plurality of packs and the strap.

29. A method according to claim 16, comprising inserting a respective bundle of smoking articles in a respective one of the plurality of assembled packs.

30. A packaging apparatus comprising:

an at least one packing machine operable to assemble a plurality of assembled packs;

strap application means operable to apply a strap to one face of all but one of the plurality of assembled packs;

conveying means operable to guide the assembled packs such that the face of each assembled pack having the strap attached thereto abuts a face of another of the plurality of the assembled packs such that the strap is sandwiched between the abutting faces;

fixing means operable to fix the strap about adjacent packs such that the packs are joined together and are movable relative to each other by rotation about one or more edges, wherein the fixing means further comprises at least one of a heater and cooler;

adhesive application means operable to apply adhesive to at least one of the strap and a corresponding region on adjacent packs; and attaching means operable to attach the strap about adjacent packs such that adjacent packs are movable relative to each other about one or more edges, wherein the attaching means is operable to attach part of the strap to the pack having the strap applied thereto and to attach another part of the strap to an adjacent pack, which adjacent pack abuts the pack having the strap applied thereto, wherein the attaching means further comprises a guide system operable to receive the assembly of the plurality of packs and the strap, and wherein the combination of packs and strap pass through the guide system in one direction such that end regions of the strap are forced to move in the opposite direction, wherein part of each strap attaches to a respective one of two faces of adjacent packs, the two faces being faces other than the abutting faces.

31. A method of packaging articles comprising:

assembling a plurality of assembled packs;

adjusting the orientation of at least one of the plurality of packs such that the plurality of packs are in the same orientation;

applying a strap to one face of all but one of the plurality of assembled packs;

applying adhesive to at least one of the strap and a corresponding region on adjacent packs;

guiding the plurality of assembled packs such that the face of each assembled pack having the strap applied thereto abuts a corresponding face of another of the plurality of assembled packs and thereby sandwiching the strap between the abutting faces;

fixing the strap about adjacent packs such that the packs are joined together and are movable relative to each other by rotation about one or more edges;

applying an outer frame member, which includes a lid portion to the combination of plurality of packs and the strap and the folding the outer blank and lid portion about the combination of the plurality of packs and the strap; and assembling respective assembled packs about respective bundles of smoking articles prior to joining together the plurality of packs and the strap.

* * * * *